US010234881B1

(12) United States Patent
Goyal et al.

(10) Patent No.: US 10,234,881 B1
(45) Date of Patent: Mar. 19, 2019

(54) DIGITALLY-ASSISTED CAPLESS VOLTAGE REGULATOR

(71) Applicant: NXP B.V., Eindhoven (NL)

(72) Inventors: Shishir Goyal, Bangalore (IN); Arvind Sherigar, Bangalore (IN)

(73) Assignee: NXP B.V., San Jose, CA (US)

( * ) Notice: Subject to any disclaimer, the term of this patent is extended or adjusted under 35 U.S.C. 154(b) by 88 days.

(21) Appl. No.: 15/805,138

(22) Filed: Nov. 7, 2017

(51) Int. Cl.
*G05F 1/575* (2006.01)
*G05F 1/565* (2006.01)
*G05F 1/46* (2006.01)

(52) U.S. Cl.
CPC ..... *G05F 1/575* (2013.01); *G05F 1/462* (2013.01); *G05F 1/565* (2013.01)

(58) Field of Classification Search
None
See application file for complete search history.

(56) References Cited

U.S. PATENT DOCUMENTS 6,222,354 B1 4/2001 Song
6,268,716 B1 7/2001 Burstein
6,437,622 B1 8/2002 Tinsley et al.
7,508,246 B2 3/2009 Kase et al.
7,602,166 B1 10/2009 Kang
8,901,904 B2 12/2014 Caldwell
9,170,592 B2 10/2015 Seymour et al.
9,588,541 B1 * 3/2017 Ho ..... G05F 3/267
2004/0004468 A1 * 1/2004 Dearn ..... G05F 1/575 323/280
2008/0192518 A1 * 8/2008 Missoni ..... H03G 1/0017 363/65
2011/0001458 A1 * 1/2011 Bansal ..... G05F 1/575 323/282
2011/0316506 A1 * 12/2011 Bulzacchelli ..... G05F 1/575 323/282
2014/0266103 A1 9/2014 Wang
2016/0124448 A1 5/2016 Murukumpet
2017/0075402 A1 3/2017 Pant et al.
2017/0351282 A1 * 12/2017 Leibowitz ..... G11C 5/147

OTHER PUBLICATIONS

Yongfu Li et al., "A 0.45-to-1.2-V Fully Digital Low-Dropout Voltage Regulator with Fast-Transient Controller for Near/Subthreshold Circuits," IEEE Transactions on Power Electronics, vol. 31, No. 9, Sep. 2016.

* cited by examiner

*Primary Examiner* — Henry Lee, III
(74) *Attorney, Agent, or Firm* — Charles E. Bergere

(57) ABSTRACT

A voltage regulator has a slow loop for providing a regulated DC current and a fast loop for providing a transient current. Feedback information is used to monitor the output voltage and control the current used to generate the output voltage. The voltage regulator does not need a capacitor to create transient current.

15 Claims, 5 Drawing Sheets

-PRIOR ART-

DIGITALLY-ASSISTED CAPLESS VOLTAGE REGULATOR

BACKGROUND

The present invention relates generally to electronic circuits, and more particularly, to a voltage regulator.

Integrated circuits (ICs) such as system-on-chips (SoCs) and application specific integrated circuits (ASICs) integrate various analog and digital components (hereinafter "electronic components") on a single chip. The electronic components require a stable supply voltage for performing various operations. ICs include voltage regulators for regulating supply voltage. Voltage regulators reject noise injected into a supply voltage from a voltage source and provide regulated output voltage signals to the electronic components.

A gate driver is an example of an electronic component. The gate driver is connected to the voltage regulator and receives the regulated output voltage signal. The gate driver provides a gate driver signal that controls the switching operation of an external transistor, which in turn drives other electronic components. For efficient transistor switching, the gate driver needs a transient current to ramp up and down the voltage level of the gate driver signal within a very short time span, e.g., 10 nanoseconds (ns). However, the voltage regulator does not generate or provide a transient current to the gate driver. A known solution to overcome this problem is to use a capacitor with the voltage regulator to provide the transient current to the gate driver.

FIG. 1 shows an integrated circuit 100 that includes a conventional voltage regulator 102 and a gate driver (GD) 104. The voltage regulator 102 is connected to a voltage supply 106 by way of first and second pins 108*a* and 108*b* for receiving a first supply voltage (VBAT), and has an output terminal for providing an output voltage signal (VOUT) at a third pin 108*c*. The voltage regulator 102 regulates a voltage level of the output voltage signal (VOUT) to a desired voltage level. An external compensation capacitor 110 is connected to the voltage supply 106, and to the voltage regulator 102 by way of the third and second pins 108*c* and 108*b*, respectively.

The gate driver 104 is connected between the output of the voltage regulator 102 and one end of the supply voltage 106, and has an input terminal that receives an enable signal (ENABLE) and an output terminal that provides a gate driver signal (GDS). The GDS is connected to the gate of an external transistor 112 by way of a fourth pin 108*d*. The drain of the external transistor 112 is connected to a second supply voltage (VDD), and a source terminal is connected to the voltage supply 106, and to the voltage regulator 102 by way of the second pin 108*b*. The source terminal of the transistor 112 also is connected to one end of the compensation capacitor 110.

The output voltage signal (VOUT) is provided to the gate driver 104 and the compensation capacitor 110. The output voltage signal (VOUT) charges the compensation capacitor 110. When the compensation capacitor 110 is charged, the gate driver 104 receives a transient current from the compensation capacitor 110 for quickly increasing and decreasing the voltage level of the gate driver signal (GDS), which turns ON the transistor 112. Thus, the gate driver pulls the current out of the supply, which is generated by the voltage regulator and the external capacitor, so the voltage regulator provides DC regulation and the external capacitor provides the transient current. One drawback, however, of this solution is the necessity of the third pin 108*c* for connecting the voltage regulator to the external compensation capacitor 110.

Another solution is to integrate the compensation capacitor 110 into the integrated circuit 100 to eliminate the need for the third pin 108*c*. However, this increases the complexity, die area, and cost of the IC 100.

Therefore, it would be advantageous to have a voltage regulator that eliminates the need for a compensation capacitor to provide transient current to a gate driver, without significantly increasing the complexity or die area of the integrated circuit.

BRIEF DESCRIPTION OF THE DRAWINGS

The following detailed description of the preferred embodiments of the present invention will be better understood when read in conjunction with the appended drawings. The present invention is illustrated by way of example, and not limited by the accompanying figures, in which like references indicate similar elements.

DETAILED DESCRIPTION

Figure 1:
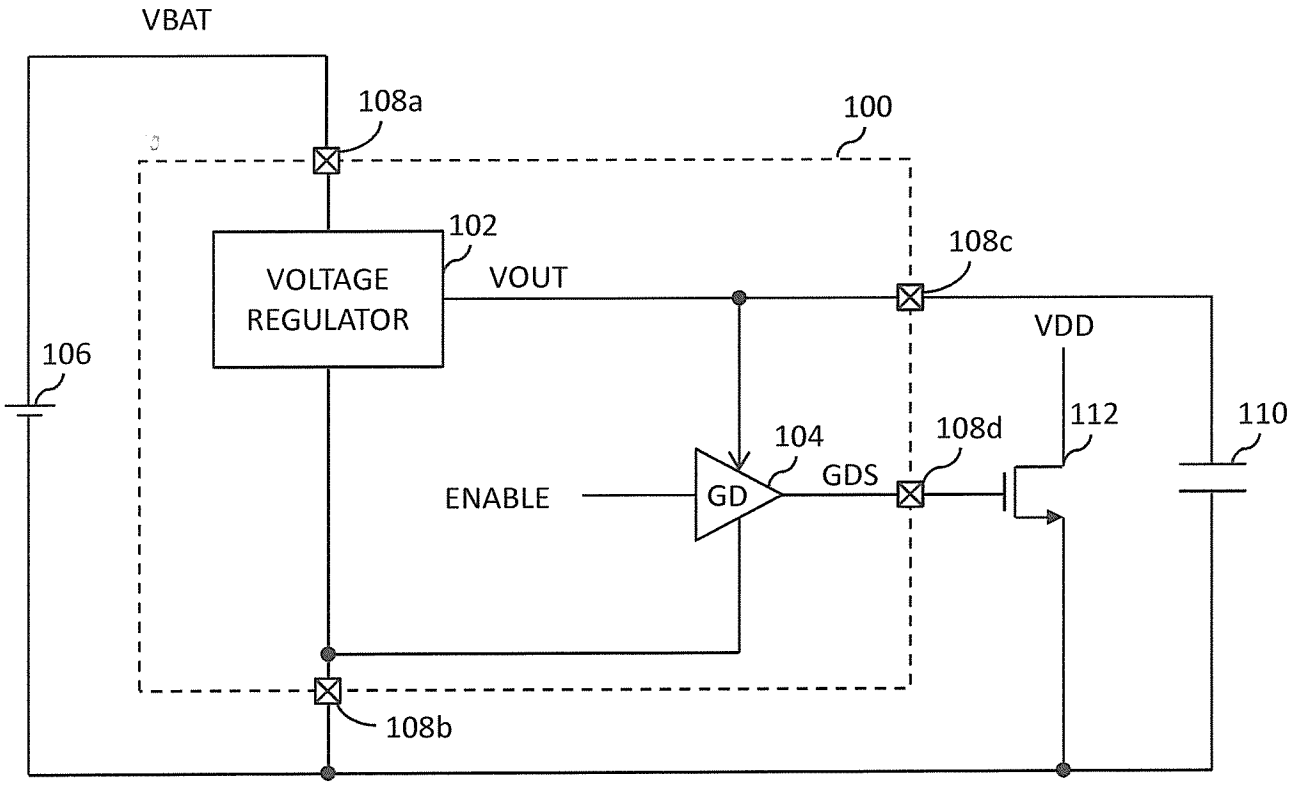
FIG. 1 is a schematic block diagram of a conventional voltage regulator in an integrated circuit.

The detailed description of the appended drawings is intended as a description of the currently preferred embodiments of the present invention, and is not intended to represent the only form in which the present invention may be practiced. It is to be understood that the same or equivalent functions may be accomplished by different embodiments that are intended to be encompassed within the spirit and scope of the present invention.

In one embodiment, the present invention comprises a voltage regulator that controls a voltage level of a gate driver signal. The voltage regulator includes a controller, a first transistor, a current control circuit, and a switch. The controller receives first and second comparison signals, which have values based on comparisons of an output voltage and the gate driver signal with first and second reference voltages, respectively, and generates first, second, and third control signals. A gate terminal of the first transistor receives one of a high side voltage signal and a gate voltage signal, based on the first control signal. A source terminal of the first transistor is connected to an output node such that the first transistor supplies a first current to the output node to control a voltage level of the output voltage signal. The switch has a switch terminal connected to the controller for receiving the third control signal, which controls opening and closing of the switch. When the switch is closed, a slow loop is enabled in which a voltage level of the gate voltage signal is pulled down to turn off the first transistor, which controls the voltage level of the output voltage signal. The current control circuit is connected to the controller for receiving the second control signal. The current control circuit forms a fast loop that is enabled when the switch is open. When the switch is open, the fast loop is enabled and the slow loop is disabled. With the fast loop enabled, the current control circuit drains a second current from the output node to control the voltage level of the output voltage signal.

In another embodiment, the present invention comprises an integrated circuit that includes the voltage regulator and the gate driver.

Various embodiments of the present invention provide a voltage regulator having a controller, a first transistor, a current control circuit, a switch, and first and second comparators. The voltage regulator generates an output voltage signal, which is provided to a gate driver. The gate driver outputs a gate driver signal that is used to control switching of a second transistor, which in turn drives a load. The first comparator generates a first comparison signal based on a comparison of the output voltage signal with a first reference voltage, and the second comparator generates a second comparison signal based on a comparison of the gate driver signal with a second reference voltage. The controller receives the first and second comparison signals, and generates first, second, and third control signals. The first transistor provides the output voltage signal at its source terminal, and supplies a first current to an output node. The first current is used to control a voltage level of the output voltage signal, based on the control signals. The switch is opened and closed based on the third control signal. When the switch is closed, a slow loop is enabled in which a voltage applied to the gate of the first transistor is controlled. When the switch is open, a fast loop is enabled in which the voltage level of the output voltage signal is controlled by the current control circuit. The current control circuit drains a second current from the output node to control the voltage level of the output voltage signal, based on a value of the second control signal, which is a multi-bit signal.

The voltage regulator provides transient current to the gate driver by way of the first and second current, and hence there is no need for a compensation capacitor to provide transient current to the gate driver.

Figure 2:
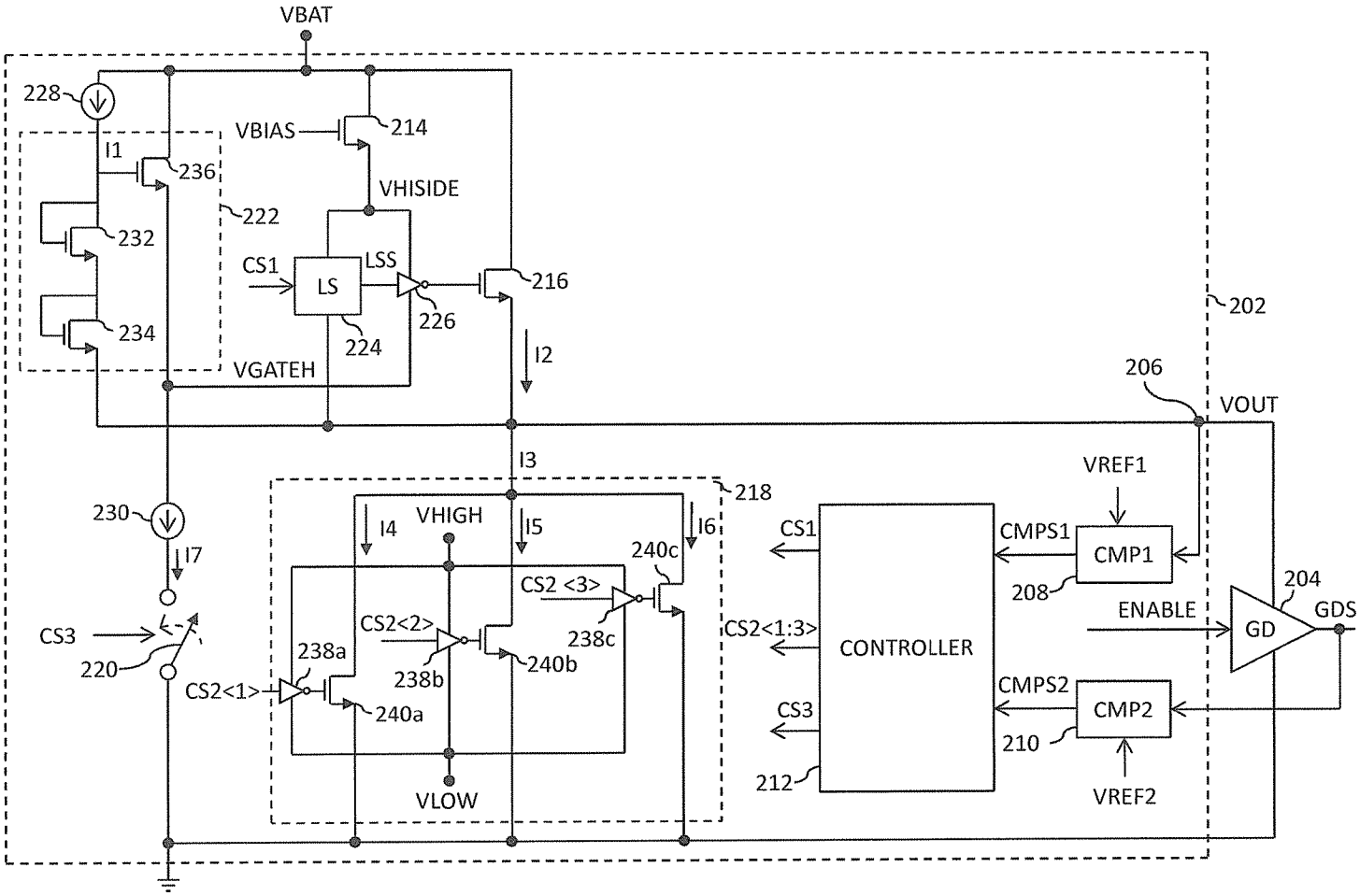
FIG. 2 is a schematic block diagram of a voltage regulator in accordance with an embodiment of the present invention.

Referring now to FIG. 2, a schematic block diagram of a voltage regulator 202 in accordance with an embodiment of the present invention is shown. The voltage regulator 202 may be connected to a gate driver 204. The voltage regulator 202 receives a first supply voltage (VBAT) from a first voltage supply (e.g., a battery) and generates an output voltage signal (VOUT) at an output node 206. The output voltage VOUT is provided to the gate driver 204. As will be discussed below, the voltage regulator 202 and the gate driver 204 may both be formed on the same integrated circuit.

The voltage regulator 202 includes first and second comparators 208 and 210, a controller 212, first and second transistors 214 and 216, a current control circuit 218, a switch 220, a biasing circuit 222, a level shifter 224, a first inverter 226, and first and second current sources 228 and 230. The biasing circuit 222 includes third through fifth transistors 232-236, while the current control circuit 218 includes second through fourth inverters 238*a*-238*c*, and sixth through eighth transistors 240*a*-240*c*. The first through eighth transistors 214, 216, 232-236, and 240*a*-240*c* preferably are either all PMOS transistors or all NMOS transistors.

The gate driver 204 is connected between the node 206 and ground, that is, between the output voltage signal VOUT and ground. The gate driver 204 also has an input terminal that receives an enable signal ENABLE, and an output terminal that provides a gate driver signal (GDS). In one embodiment, the gate driver 204 receives the enable signal ENABLE from an external control signal generator or a microcontroller. The voltage regulator 202 provides the output voltage signal VOUT and a transient current to the gate driver 204, which quickly ramps up and down a voltage level of the gate driver signal (GDS), such as 10 nanoseconds (ns).

As can be seen from FIG. 2, the voltage regulator 202 has a slow loop for DC regulation, which is the loop controlled by the switch 220 and the third control bit CS3, and a fast loop for supplying the transient load currents, which is the loop through the low side power stage or current control circuit 218.

The current control circuit 218 (low side power stage) is broken down into a number of units n (i.e., inverter and transistor pairs) to allow for a smooth response, and is controlled by the second control signal CS2<1:n>. In the embodiment shown, n=3. In order to control the high side devices (i.e., the second transistor 216), the first control signal CS1 is level-shifted from the digital domain to the high-side domain (VHISIDE-VDDA). If CS1 is low/high then the gate of the second transistor 216 is connected to VGATEH/VHISIDE, respectively. The high side supply VHISIDE is created using the first transistor 214, which is sized to ensure that it can provide enough current to charge the gate of the second transistor 216 within a certain time.

The first comparator 208 is connected to the output node 206 and receives the output voltage signal VOUT. The first comparator 206 also receives a first reference signal (VREF1). The first reference signal (VREF1) is a bandgap reference voltage signal. In one embodiment, the first comparator 208 receives the first reference signal VREF1 from an external bandgap voltage generator (not shown). The first comparator 206 compares the output voltage signal VOUT and the first reference signal VREF1, and generates a first comparison signal (CMPS1). In one embodiment, when a voltage level of the output voltage signal VOUT is greater than a voltage level of the first reference signal VREF1, then the first comparison signal CMPS1 goes high (i.e., an active state), and when VOUT is less than VREF1, then CMPS1 goes low (inactive). In a presently preferred embodiment, the first comparator 208 comprises a Flash analog-to-digital (ADC), which in this case may be just a 1-bit comparator. The output of the first comparator 208 is used to control the PWM signal (third control signal), such that VOUT becomes equal to the reference voltage (VREF1).

Internal signals from the gate driver 204 are used to indicate when the load current will ramp up. As soon as the indication is received, the second transistor 216 (high side NMOS) is activated to provide the current. As the ramp rate is more than 1V/ns, activation of the second transistor 216 ensures that the supply voltage VOUT does not fall below a threshold (VREF2). Information about the voltage waveform at the gate of an external MOSFET (same as the output of the gate driver 204) is fed back to the voltage regulator 202. This helps in faster response to changes in the current load resulting in better voltage regulation. For example, when the slope of the gate voltage waveform decreases, which indicates that the current will start to decrease, this information is used to determine the direction in which the regulator 202 should provide current. If there is current spike, this information helps to keep the output voltage (VOUT) within acceptable limits. The output feedback to the voltage regulator 202 is digitized using a flash ADC (the second comparator 210) running on a fast clock (e.g. 300 MHz).

The second comparator 210 is connected to the gate driver 204 and receives the gate driver signal GDS. The second comparator also receives a second reference signal (VREF2) that has a predefined slope value, and generates a second comparison signal (CMPS2). In one embodiment, the second comparator 210 receives the second reference signal VREF2 from an external memory (not shown). In operation, when a slope of the gate driver signal GDS is greater than the second reference signal VREF2, then the second comparison signal CMPS2 goes high (i.e., an active state), and when the slope of the gate driver signal GDS is less than the second reference signal VREF2, the second comparison signal CMPS2 goes low (inactive).

The controller 212 is connected to the first and second comparators 208 and 210 and receives the first and second comparison signals CMPS1 and CMPS2, respectively. The controller 212 generates first, second, and third control signals (CS1), (CS2<1:3>), and (CS3) based on the first and second comparison signals CMPS1 and CMPS2. The controller 212 may comprise, for example, a digital controller, an application specific integrated circuit (ASIC) processor, a reduced instruction set computer (RISC) processor, a complex instruction set computer (CISC) processor, a field programmable gate array (FPGA) processor, etc. The first control signal CS1 is either high or low, based on the logic state of the first and second comparison signals CMPS1 and CMPS2. The second control signal (CS2<1:3>) is a three-bit digital code including first through third bits CS2<1:3>, which also are either high or low, i.e., active or inactive, depending on the logic state of the first and second comparison signals CMPS1 and CMPS2. The third control signal CS3 is a pulse width modulated (PWM) signal, where the controller 212 controls a duty cycle of the third control signal CS3, based on the first comparison signal CMPS1. Initial values of the control bits CS1-CS3 will be discussed in more detail below with reference to FIGS. 3A-3C.

The first current source 228 is connected to the first voltage supply for receiving the first supply voltage VBAT, and generates a first current (I1).

The first transistor 214 has a drain terminal connected to the first voltage supply for receiving the first supply voltage VBAT, a gate terminal that receives a bias voltage signal (VBIAS), and a source terminal that provides a high side voltage signal (VHISIDE). The bias voltage signal VBIAS may be generated by an external bias voltage generator circuit (not shown).

The second transistor 216 has a drain terminal connected to the first voltage supply for receiving the first supply voltage VBAT, and a source terminal connected to the output node 206.

The third transistor 232 has gate and drain terminals connected to the output of the first current source 228 for receiving the first current I1, and a source terminal connected to a drain terminal of the fourth transistor 234. The fourth transistor 234 has a gate terminal connected to its drain terminal and to the source of the third transistor, and a source terminal connected to the output node 206. The fifth transistor 236 has a drain terminal connected to the first voltage supply for receiving the first supply voltage VBAT, a gate terminal connected to the output of the first current source 228 for receiving the first current I1, and a source terminal that provides a gate voltage signal (VGATEH) that has a predetermined voltage level. In one embodiment, the predetermined voltage level of the gate voltage signal VGATEH is VOUT+VGS of the second transistor 216.

The level shifter 224 is connected between the first and fourth transistors 214 and the output node (i.e., between VHISIDE and VOUT). The level shifter 224 receives the first control signal CS1 and generates a level shifted signal (LSS), where a voltage level of the level shifted signal LSS is based on the logic state of the first control signal CS1. More particularly, when the first control signal CS1 is high, the level shifter 224 outputs the level shifted signal LSS at a first voltage level, and when the first control signal CS1 is low, the level shifter 224 outputs the level shifted signal LSS at a second voltage level. Examples of the first and second voltage levels of LSS are VHISIDE and VOUT, respectively.

The first inverter 226 is connected between the source terminals of the first and fifth transistors 214, 236, and receives the high side voltage signal VHISIDE and the gate voltage signal VGATEH. The first inverter 226 receives as an input the level shifted signal LSS, and outputs one of the high side voltage signal VHISIDE and the gate voltage signal VGATEH (hereinafter referred to as "first inverter output"), depending on the value of the input signal LSS. More particularly, when the LSS is at the second voltage level, the first inverter output has the value of the high side voltage signal VHISIDE, and when the LSS is at the first voltage level, the first inverter output has the value of the gate voltage signal VGATEH.

The second transistor 216 receives the first inverter output at its gate terminal, and supplies a second current I2 to the output node 206 by way of its source terminal. As noted above, the gate terminal of the second transistor 216 receives one of the high side voltage signal VHISIDE and the gate voltage signal VGATEH depending on the logic state of the first control signal CS1. In one embodiment, the high side voltage signal VHISIDE is greater than the gate voltage signal VGATEH. When the level shifted signal LSS is at the high side voltage level, the gate terminal of the second transistor 216 receives the gate voltage signal VGATEH, and when LSS is at the gate voltage level, the gate terminal of the second transistor 216 receives the high side voltage signal VHISIDE. The second transistor 216 supplies the second current I2 to control a voltage level of the output voltage signal (VOUT). In one embodiment, when the gate terminal of the second transistor 216 receives the high side voltage signal VHISIDE, the magnitude of the second current I2 is greater than when the gate terminal of the second transistor 216 receives the gate voltage signal VGATEH. The second current I2 increases current flow to the output node 206, which increases the voltage level of the output voltage signal VOUT.

The slow loop of the voltage regulator 202 comprises the second transistor 216, the biasing circuit 222, the first and second current sources 228 and 230, the switch 220, as well as the first comparator 208 and the controller 212. The gate voltage VGATEH is set by the trans-linear loop formed by the second transistor 216 and the transistors of the biasing circuit 222, and adjusted by controlling the switch 220. When the switch 220 is ON, current flows through the fifth transistor 236, which discharges the gate of the second transistor 216, and when the switch 220 is OFF, the current through the fifth transistor 236 charges the gate of the second transistor 216.

The fast loop is formed by the current control circuit when the switch 220 is open. The current control circuit 218 is connected between the output node 206 and ground, and receives the second control signal CS2<1:3>. The current control circuit 218 drains a third current (I3) from the output node 206 to control the voltage level of the output voltage signal (VOUT). In more detail, the second inverter 238*a*, which is connected between a high voltage signal VHIGH and a low voltage signal VLOW, receives as an input the first bit (CS2<1>) of the second control signal, and outputs one of the high and low voltage signals VHIGH and VLOW depending on the logic state of CS2<1> as the second inverter output. When CS2<1> is low, the second inverter output has a value of VHIGH, and when CS2<1> is high, the second inverter output has a value of VLOW. In one embodiment, the high and low voltage signals VHIGH and VLOW are generated by an external voltage supply circuit (not shown).

The sixth transistor 240*a* has a gate terminal connected to the output of the second inverter 238*a* for receiving the second inverter output, a drain terminal connected to the output node 206 for draining a fourth current (I4), and a source terminal connected to ground. Thus, the gate terminal of the sixth transistor 240*a* receives VHIGH as the second inverter output when CS2<1> is low, and receives VLOW as the second inverter output, when CS2<1> is high. When gate of the sixth transistor 240*a* receives VHIGH, then the sixth transistor 240*a* is turned ON, and hence the sixth transistor 240*a* drains the fourth current I4 from the output node 206. When the gate of the sixth transistor 240*a* receives VLOW, then the sixth transistor 240*a* is switched OFF, and hence the sixth transistor 240*a* does not drain the fourth current I4 from the output node 206.

The third and fourth inverters 238*b* and 238*c* also are connected between the high and low voltage signals VHIGH and VLOW. The third inverter 238*b* receives the second bit of the second control signal CS2<2> at its input, and the fourth inverter 2338*c* receives the third bit of the second control signal CS2<3> at its input. The third and fourth inverters 238*b* and 238*c* then output one of the high and low voltage signals VHIGH and VLOW, depending on the logic state of its input (i.e., CS2<2> and CS2<3>). Thus, when CS2<2> is low, the third inverter output has a value of VHIGH; when CS2<2> is high, the third inverter output has a value of VLOW; when CS2<3> is low, the fourth inverter output has a value of VHIGH; and when CS2<3> is high, the fourth inverter output has a value of VLOW.

The seventh transistor 240*b* has a gate terminal connected to the output of the third inverter 238*b* for receiving the third inverter output, a drain terminal connected to the output node 206 for draining a fifth current (I5) from the output node 206, and a source terminal connected to ground. Thus, the gate terminal of the seventh transistor 240*b* receives VHIGH as the third inverter output when the CS2<2> is low, and receives VLOW as the third inverter output when CS2<2> is high. When the gate of the seventh transistor 240*b* receives VHIGH, then the seventh transistor 240*b* switches ON, and the seventh transistor 240*b* drains the fifth current I5 from the output node 20). When the gate of the seventh transistor 240*b* receives VLOW (when CS2<2> is active), the seventh transistor 240*b* is switched OFF, and hence the seventh transistor 240*b* does not drain the fifth current I5 from the output node 206.

The eighth transistor 240*c* has a gate terminal connected to the output of the fourth inverter 238*c* and receives the fourth inverter output, a drain terminal connected to the second output node 206*b* for draining a sixth current (I6) from the output node 206, and a source terminal connected to ground. When the gate terminal of the eighth transistor 240*c* receives VHIGH (because CS2<3> is low/inactive, then the eighth transistor 240*c* is switched ON, which drains the sixth current I6 from the output node 206, and when the gate terminal of the eighth transistor 240*c* receives VLOW (because CS2<3> is high/active, then the eighth transistor 240*c* is switched OFF, so the sixth current I6 is not drained from the output node 206.

The third current I3 is a sum of the fourth, fifth and sixth currents I4, I5, and I6. Further, draining the third current I3 reduces the current flow into the output node 206, which reduces the voltage level of the output voltage signal (VOUT).

It will be understood by a person skilled in the art that the current control circuit 218 may be modified to have more than three transistors and three inverters based on system requirements, and that the number of bits of the second control signal CS2 may be modified accordingly.

The second current source 230 has a first terminal connected to the source terminal of the fifth transistor 236 and a second terminal connected to the switch 220 for supplying a seventh current (I7) to the switch. The switch 220 is connected between the second current source 230 and ground, and receives the seventh current I7 from the second current source 230. The switch 220 is controlled by the third control signal CS3. For example, when the third control signal CS3 is low/inactive, then the switch 220 is open, and when the third control signal CS3 is high/active, then the switch 220 is closed. The switch 220 thus controls the level of the gate voltage signal VGATEH based on the duty cycle of the third control signal (CS3). When the third control signal (CS3) is high/active, the switch 220 turns ON the second current source 230 and the seventh current I7 flows through the second current source 230 to ground, which decreases the voltage level of the gate voltage signal VGATEH. Conversely, when the third control signal CS3 is low/inactive, the switch 220 is open, which turns OFF the second current source 230, thereby increasing the voltage level of the gate voltage signal (VGATEH) to the predetermined voltage level. The switch 220 may comprise, for example, a silicon controlled rectifier (SCR), gate turn-off (GTO) thyristor, metal oxide semiconductor (MOS) controlled thyristor, insulated-gate bipolar transistor (IGBT), and the like.

The voltage regulator 202 provides transient current to the gate driver 204 by supplying the second current I2 and draining the third current I3 at the output node 204 (i.e., using the fast loop). The voltage level of the output voltage signal VOUT may increase or decrease based on the current flow into the output node 206. The gate driver 204 outputs the gate driver signal GDS at a voltage level that corresponds to the output voltage signal VOUT. Hence, the voltage level of the gate driver signal GDS increases when the current flow into the output node 206 increases, and the voltage level of the gate driver signal (GDS) decreases when the current flow into the output node 206 decreases. In this way, the voltage regulator 202 provides transient current to the gate driver 204 to ramp up and down the voltage level of the gate driver signal GDS without the need for a compensation capacitor. The operation of the voltage regulator 202 will be explained in more detail using the flow chart shown in FIGS. 3A, 3B, and 3C.

Figure 3A:
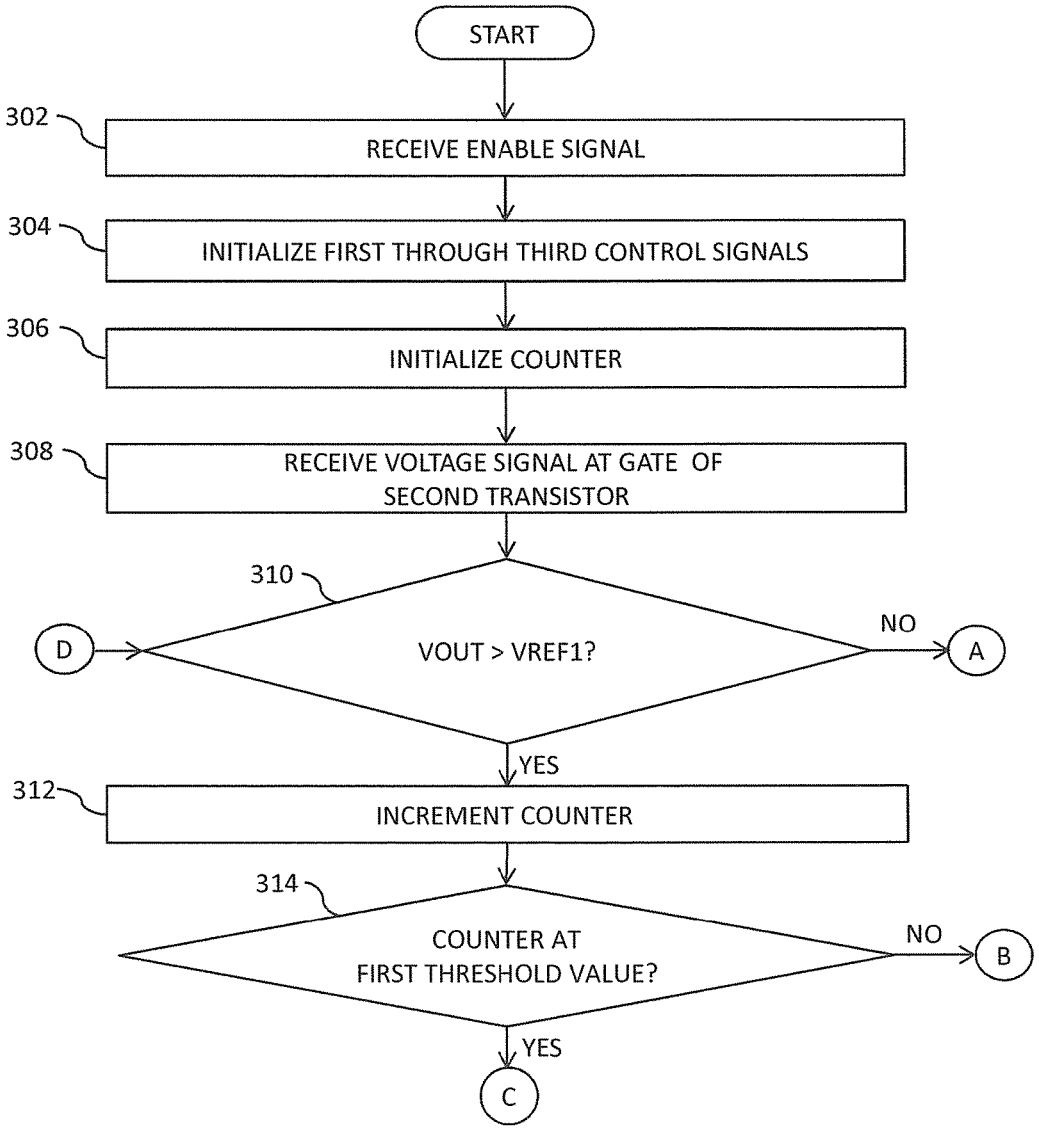
FIGS. 3A, 3B, and 3C are a flow chart illustrating an operation of the voltage regulator of FIG. 2 in accordance with an embodiment of the present invention.
Figure 3B:
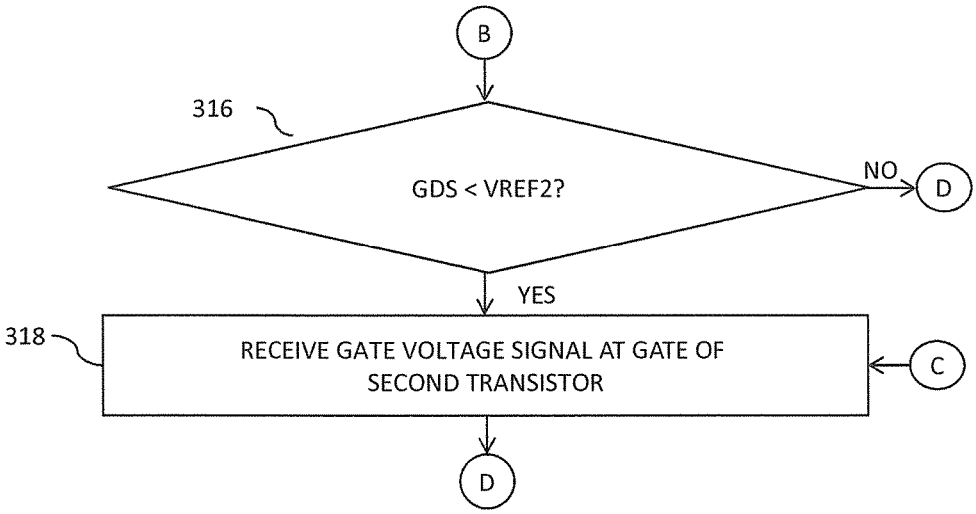
Figure 3C:
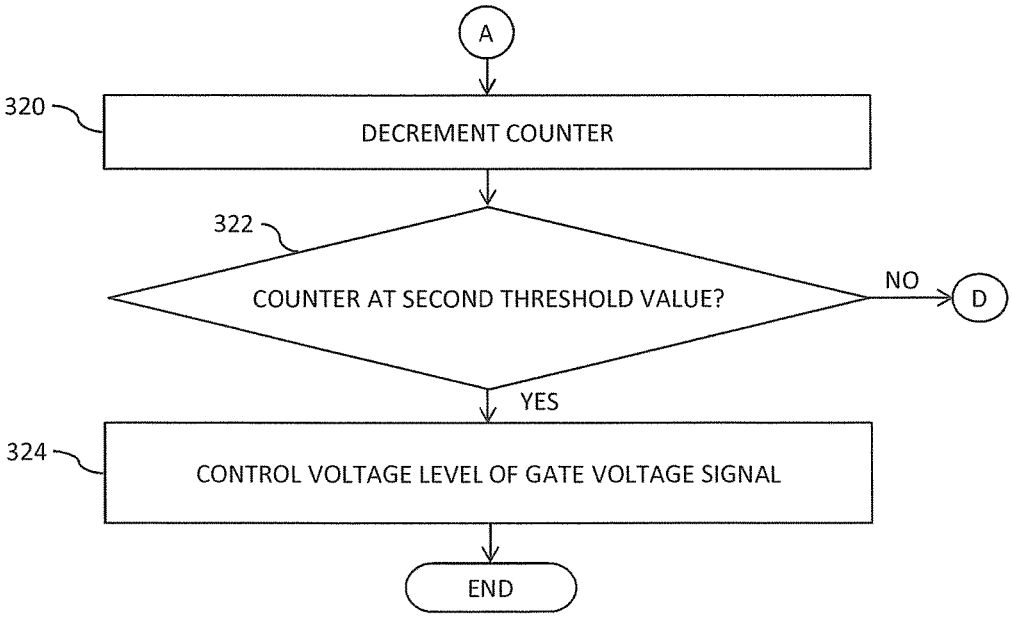

FIGS. 3A, 3B, and 3C are a flow chart illustrating the operation of the voltage regulator 202 of FIG. 2 in accordance with an embodiment of the present invention is shown. At step 302, the gate driver 204 receives the enable signal ENABLE and outputs the gate driver signal GDS.

At step 304, the controller 212 initializes the first through third control signals CS1, CS2, and CS3 to first through third predetermined values, respectively. In one embodiment, the first predetermined value is low/inactive, the second predetermined value is a high/active, and the third predetermined value is a zero duty cycle. Since the first control signal CS1 is low, the output of the level shifter 224 is low and output of the first inverter 226 is high, which is the high side voltage signal VHISIDE. Since CS2 is high/active (i.e., '111'), the second through fourth inverters 238*a*-238*c* each outputs the low voltage signal VLOW. Since the third control signal CS3 has a zero duty cycle, the switch 220 is OFF (open), which turns OFF the second current source 230.

At step 306, the controller 212 initializes a counter to a fourth predetermined value. In one embodiment, the fourth predetermined value is "0". A value of the counter represents the number of bits of the second control signal CS2<1:3> that are low.

At step 308, the gate of the second transistor 216 is connected to receive the high side voltage VHISIDE to increase drive and enable sufficient current to the gate driver 204. That is, the gate terminal of the second transistor 216 receives the high side voltage signal VHISIDE from the first inverter 226, which switches ON the second transistor 216. The sixth through eighth transistors 240*a*-240*c* receive the low voltage signal VLOW from the second through fourth inverters 238*a*-238*c*, which switches OFF the sixth through eighth transistors 240*a*-240*c*, so the second transistor 216 supplies the second current I2 to the output node 206, which increases the voltage level of the output voltage signal VOUT, and the current control circuit 218 does not drain the third current I3 from the output node 206 because the sixth through eighth transistors 240*a*-240*c* are all OFF.

At step 310, the controller 212 determines whether the voltage level of the output voltage signal VOUT is greater than the voltage level of the first reference signal VREF1, based on the value of the first comparison signal CMPS1. If VOUT is greater than VREF1, that indicates VOUT is too strong for the current requirement, so the transistors of the current control circuit 218 will be turned on, one-by-one, until VOUT equals VREF2. In one embodiment, when the first comparison signal CMPS1 is high/active, the controller 212 determines that VOUT is greater than VREF1, and when CMPS1 is low, the controller 212 determines that VOUT is less than VREF1. If at step 310, the controller 212 determines that VOUT is greater than VREF1, then the voltage regulator 202 executes step 312.

At step 312, the controller 212 increments the counter, which changes one bit of the second control signal CS2<1:3>, to turn on the transistors of the current control circuit 218, one-by-one, as mentioned above.

At step 314, the controller 212 determines whether the counter is at a first threshold value. In the preferred embodiment, the first threshold value equals the number of transistors in the current control circuit 218 (i.e., 3, as shown in FIG. 2). By having a number n of stages in the low side power stage (the current control circuit 218), the slope of the gate driver signal can be compared to predetermined slope value, and the stages allow the output voltage to be precisely managed. When the slope of the gate driver signal decreases below a threshold, then the current from the gate driver 204 will start to decrease, so the gate of the second transistor 216 is connected to VGATEH and the stages in the current control circuit 218 weaken VOUT. If at step 314, the controller 212 determines that the counter has reached the first threshold value, then the voltage regulator 202 executes step 316 (FIG. 3B).

At step 316, the controller 212 determines whether the slope of the gate driver signal (GDS) is less than the second reference signal (VREF2), based on the logic state of the second comparison signal (CMPS2). For example, when the second comparison signal CMPS2 is high, i.e., active, the controller 212 determines that the slope of the gate driver signal GDS is greater than the second reference signal VREF2. Conversely, when the second comparison signal CMPS2 is low (not active), the controller 212 determines that the slope of the gate driver signal GDS is less than the second reference signal VREF2. At step 316, if the slope of GDS is not less than VREF2 (CMPS2 is high), then the voltage regulator 202 executes step 310. Alternatively, if the slope of GDS is less than VREF2 (CMPS2 is low), then the voltage regulator 202 executes step 318.

At step 318, since the slope of GDS is less than VREF2, the controller 212 sets the first control signal CS1 (high active), so the output of the level shifter 224 is high and the output of the first inverter 226 goes low, and hence the second transistor 216 receives the gate voltage signal VGATEH. The voltage regulator 202 next executes step 310.

Referring again to step 314, if the controller 212 determines that the counter is equal to the first threshold value, then the voltage regulator 202 executes step 318.

Referring again to step 310, if the controller 212 determines that the voltage level of the output voltage signal VOUT is not greater than the first reference signal VREF1, then the voltage regulator 202 executes step 320. That is, if VOUT starts to fall below VREF1, then the low side is too strong so the low side devices (transistors 240*a*, 240*b*, 240*c*) are turned OFF, one-by-one, until VOUT is equal to VREF1. Thus, at step 320, the controller 212 decrements the counter, which changes the value of CS2, to shut off one of the devices 240.

At step 322, the controller 212 determines whether the counter has reached a second threshold value. In one embodiment, the second threshold value is zero. Thus, all of the devices 240 are OFF, then the regulator 202 will switch from the fast loop to the slow loop by closing the switch 220. If at step 322, the controller 212 determines that the counter is not equal to the second threshold value, the voltage regulator 202 loops back to step 310 to determine if the counter should be decremented again to shut off another one of the devices 240. If at step 322, the controller 212 determines that the counter has reached the second threshold value, then the voltage regulator 202 executes step 324 (go to the slow loop).

At step 324, the switch 220 controls the voltage level of the gate voltage signal (VGATEH) based on the third control signal CS3. The controller 212 controls the duty cycle of the third control signal CS3, i.e., the PWM signal, based on the first comparison signal CMPS1. For example, the controller 212 may change the duty cycle of the third control signal CS3 from zero to 0.5. Then, based on the duty cycle of the third control signal CS3, the switch 220 operates the second current source 230 to control the voltage level of the gate voltage signal (VGATEH). In one embodiment, when the duty cycle of the third control signal CS3 is 0.5, the switch 220 is switched ON and OFF for equal intervals of time. When the switch 220 is switched ON, the second current source 230 is switched ON. Hence, the seventh current (I7) flows through the second current source 230 and the voltage level of the gate voltage signal VGATEH is decreased from the predetermined voltage level. When the switch 220 is switched OFF (open), the second current source 230 is switched OFF. Hence, the seventh current I7 does not flow through the second current source 230 and the voltage level of the gate voltage signal VGATEH has its predetermined voltage level. The second transistor 216 is switched ON when the gate terminal of the second transistor 216 receives the gate voltage signal (VGATEH) at the predetermined voltage level. The second transistor 216 is switched OFF when the gate voltage signal VGATEH is less than the predetermined voltage level. The second transistor 216, when switched ON, supplies the second current (I2) to the output node 206, thereby increasing the voltage level of the output voltage signal (VOUT). The second transistor 216, when switched OFF, does not supply the second current I2 to the output node 206, thereby decreasing the voltage level of the output voltage signal (VOUT). Hence, based on the duty cycle of the third control signal CS3, the switch 220 controls the voltage level of the output voltage signal (VOUT).

Figure 4:
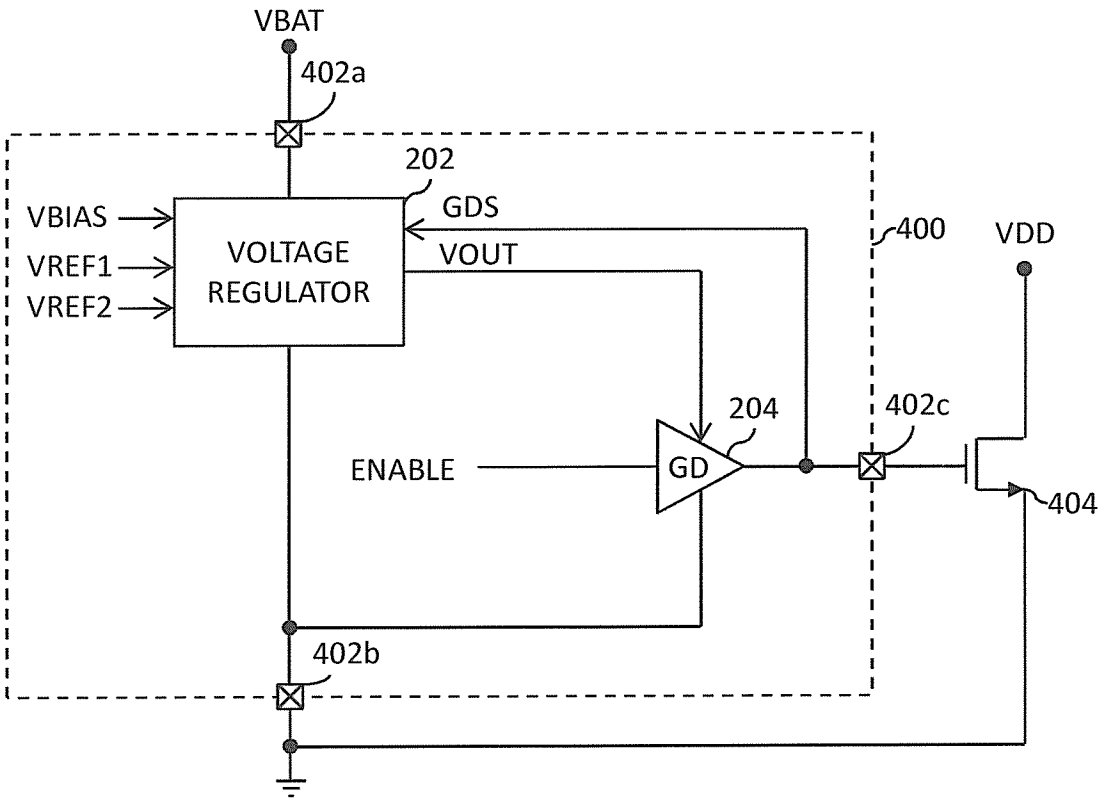
FIG. 4 is a schematic block diagram of an integrated circuit including the voltage regulator of FIG. 2, in accordance with an embodiment of the present invention.

Referring now to FIG. 4, a schematic block diagram of an integrated circuit 400 that includes the voltage regulator 202 of FIG. 2 in accordance with an embodiment of the present invention is shown. The integrated circuit 400 also includes the gate driver 204 and has three pins 402*a*, 402*b*, and 402*c*. The gate driver 204 is connected to an external, ninth transistor 404.

The ninth transistor 404 has a drain terminal that receives a second supply voltage (VDD) from a second voltage supply (not shown), a gate terminal for receiving the gate driver signal GDS, and a source terminal connected to ground. The ninth transistor 404 may comprise either a PMOS or NMOS transistor, and may be used to drive a load (not shown).

The voltage regulator 202 receives the first supply voltage VBAT by way of the pin 402*a*, and is connected to ground by way of the pin 402*b*. The pin 402*c* connects the gate driver 204 to the ninth transistor 404.

The voltage regulator 202 regulates the voltage level of the output voltage signal VOUT and provides transient current, i.e., by supplying the second current I2 and draining the third current I3, to the gate driver 204, which controls the switching operations of the ninth transistor 404. The second and third currents I2 and I3 control the current flow to the output node 206, which controls the voltage level of the output voltage signal VOUT, and thereby controls the voltage level of the gate driver signal GDS. In one embodiment, the second and third currents I2 and I3 increase and decrease the voltage level of the gate driver signal GDS, respectively, within a very short time span, such as 10 ns.

The voltage regulator 202 regulates the voltage level of the output voltage signal VOUT to a desired voltage level. The voltage regulator 202 also provides transient current, i.e., by supplying the second current I2 and draining the third current I3, which is required to turn ON the ninth transistor 404 without the need of a compensation capacitor. Hence, the voltage regulator 202 eliminates the need of an additional pin required to connect a compensation capacitor to the regulator 202. Hence, the IC 400 including the voltage regulator 202 can have a reduced die area and lower packaging cost, so the IC 400 may be less complex and less expensive than the IC 100. The voltage regulator 202 may be used in various applications that require transient current, such as a gate driver for solid state lighting (SSL) power converters, boost converters, class D amplifiers, and the like.

A digitally-assisted (NMOS) voltage regulator for high voltage and fast transient response applications that can supply currents for fast transients at the load has been described herein. The voltage regulator uses information from the load (such as the gate driver gate voltage and the slope of the gate driver output voltage) to enable fast transient response. The voltage regulator has a slow loop for DC regulation and a fast loop for supplying the transient load currents. In a preferred embodiment, the power device is a NMOS transistor that is divided into several unit elements and is biased by a trans-linear loop whose quiescent point can be adjusted digitally (with the second control signal CS2). A mixed-signal slow loop (when switch 220 is closed) adjusts the quiescent point to provide DC regulation, and the fast loop provides regulation during a current spike. The second control signal CS2 is used to increase/decrease overdrive and to turn on/off several or a single power device units (i.e., transistors 240*a*, 240*b* and 240*c*). The fast loop is generally in sleep mode and turned on when the gate driver 204 needs to charge the gate of the external MOSFET 404 (this information is available a priori from the controller 212).

The terms active and inactive states have been used herein to distinguish between high and low logic states. For example, the inactive state could signify a signal that has voltage level 0V, while an active state would then indicate a signal that has a logic '1' value, with an actual voltage level for logic '1' depending on circuit technology. The circuits described herein also can be designed using either positive or negative logic, so an active state in another embodiment could be a logic '0' and an inactive state would then be a logic '1'.

While various embodiments of the present invention have been illustrated and described, it will be clear that the present invention is not limited to these embodiments only. Numerous modifications, changes, variations, substitutions, and equivalents will be apparent to those skilled in the art, without departing from the spirit and scope of the present invention, as described in the claims.

The invention claimed is:

1. A voltage regulator for driving a gate driver, the voltage regulator comprising:

a controller that receives first and second comparison signals, and outputs first, second, and third control signals, wherein the first and second comparison signals are based on an output voltage signal of the voltage regulator and a gate driver signal generated by the gate driver, respectively;

a first transistor having a drain terminal connected to a first supply voltage (VBAT), a gate terminal for receiving an inverted level shifted signal that is based on the first control signal, and a source terminal connected to an output node for providing the output voltage signal thereto, wherein the first transistor supplies a first current to the output node for controlling a voltage level of the output voltage signal;

a switch connected to the controller for receiving the third control signal, wherein the third control signal controls opening and closing of the switch, and wherein when the switch is closed, a slow loop is enabled in which the voltage level of a biased voltage signal is pulled down to turn off the first transistor, thereby controlling the voltage level of the output voltage signal; and a current control circuit connected between the output node and ground, wherein the current control circuit forms a fast loop that is enabled when the switch is open, wherein when the current control circuit is enabled, the current control circuit drains a second current from the output node to control the voltage level of the output voltage signal;

a first comparator, connected to the output node for receiving the output voltage signal, wherein the first comparator compares the output voltage signal with a first reference voltage, and generates the first comparison signal based on the comparison result; and a second comparator, connected to the gate driver for receiving the gate driver signal, wherein the second comparator compares the gate driver signal with a second reference voltage, and generates the second comparison signal based on the comparison result.

2. The voltage regulator of claim 1, wherein the third control signal is a pulse width modulation (PWM) signal.

3. The voltage regulator of claim 2, wherein the controller sets a duty cycle of the third control signal to control the opening and closing of the switch.

4. The voltage regulator of claim 1, wherein the current control circuit comprises a plurality of units that draw current from the output node, and wherein the second control signal comprises a plurality of bits, each bit enabling a corresponding one of the plurality of units.

5. The voltage regulator of claim 4, wherein each of the plurality of units comprises:

an inverter connected to the controller for receiving a respective one of the bits of the second control signal, and outputting a voltage signal; and a transistor having a gate connected to an output of the inverter for receiving the inverter generated voltage signal, a drain connected to the output node, and a source connected to ground.

6. The voltage regulator of claim 5, wherein when the output voltage signal is greater than the first reference voltage, the units of the current control circuit are activated, one-by-one, until the output voltage signal equals the first reference voltage.

7. The voltage regulator of claim 5, wherein when the output voltage signal is less than the first reference voltage, the units of the current control circuit are deactivated, one-by-one, until the output voltage signal equals the first reference voltage.

8. The voltage regulator of claim 5, wherein if all of the units are deactivated, the third control signal is activated to close the switch.

9. A voltage regulator for driving a gate driver, comprising:

a controller that receives first and second comparison signals, and outputs first, second, and third control signals, wherein the first and second comparison signals are based on an output voltage signal of the voltage regulator and a gate driver signal generated by the gate driver, respectively;

a first transistor having a drain terminal connected to a first supply voltage (VBAT), a gate terminal for receiving an inverted level shifted signal that is based on the first control signal, and a source terminal connected to an output node for providing the output voltage signal thereto, wherein the first transistor supplies a first current to the output node for controlling a voltage level of the output voltage signal;

a switch connected to the controller for receiving the third control signal, wherein the third control signal controls opening and closing of the switch, and wherein when the switch is closed, a slow loop is enabled in which the voltage level of a biased voltage signal is pulled down to turn off the first transistor, thereby controlling the voltage level of the output voltage signal;

a current control circuit connected between the output node and ground, wherein the current control circuit forms a fast loop that is enabled when the switch is open, wherein when the current control circuit is enabled, the current control circuit drains a second current from the output node to control the voltage level of the output voltage signal;

a level shifter connected between a high side voltage and the output voltage signal, and having an input connected to the controller for receiving the first control signal, and an output that provides the level shifted signal; and a first inverter having an input connected to the level shifter for receiving the level shifted signal, and an output connected to the gate terminal of the first transistor for providing the inverted level shifted signal thereto, wherein the first inverter is connected between the high side voltage and a gate voltage such that the inverted level shifted signal has one of a value of the high side voltage and the gate voltage.

10. The voltage regulator of claim 9, further comprising:

a second transistor having a drain connected to a first supply voltage, a gate that receives a bias voltage, and a drain that provides the high side voltage to the level shifter and the first inverter.

11. The voltage regulator of claim 10, further comprising:

a biasing circuit connected to the first supply voltage, and providing the gate voltage to the first inverter.

12. The voltage regulator of claim 11, further comprising:

a first current source connected to the first supply voltage and generating a third current, and wherein the biasing circuit comprises:

a third transistor having a drain connected to the first supply voltage, a gate connected to the first current source and receiving the third current, and a source that provides the gate voltage to the first inverter;

a fourth transistor having gate and drain terminals connected to the first current source and receiving the first current; and a fifth transistor having gate and drain terminals connected to a source of the fourth transistor, and a source terminal connected to the output node.

13. The voltage regulator of claim 12, further comprising a second current source connected between the source of the third transistor and a first terminal of the switch for providing a fourth current to the switch, wherein when the switch is closed, the fourth current reduces the gate voltage provided to the first inverter.

14. The voltage regulator of claim 1, wherein the voltage regulator is connected to the gate driver for providing the output voltage signal to the gate driver.

15. The voltage regulator of claim 14, wherein the voltage regulator and the gate driver are formed on an integrated circuit.

* * * * *